US005754930A

United States Patent [19]

Stark et al.

[11] Patent Number: 5,754,930

[45] Date of Patent: May 19, 1998

[54] FLUIDIZED TONER DEVELOPMENT USING A RIGID POROUS DONOR ROLL

[75] Inventors: Howard M. Stark, Williamson; P. Keith Watson, Rochester, both of N.Y.

[73] Assignee: Xerox Corporation, Stamford, Conn.

[21] Appl. No.: 725,670

[22] Filed: Oct. 1, 1996

[51] Int. Cl.[6] ..... G03G 15/08

[52] U.S. Cl. ..... 399/290; 399/266

[58] Field of Search ..... 399/92, 222, 265, 399/266, 279, 290, 292

[56] References Cited

U.S. PATENT DOCUMENTS

| | | | |
|---|---|---|---|
| 2,732,775 | 1/1956 | Young et al. . | |
| 3,633,544 | 1/1972 | Weiler | 399/290 X |
| 3,882,822 | 5/1975 | Sullivan, Jr. | 399/290 |
| 4,996,538 | 2/1991 | Brecy et al. | 399/290 X |
| 5,649,271 | 7/1997 | Bray et al. | 399/266 |

*Primary Examiner*—Sandra L. Brase
*Attorney, Agent, or Firm*—Lloyd F. Bean, II

[57] ABSTRACT

An apparatus for developing a latent image recorded on an imaging surface, comprising a housing defining a chamber storing a supply of developer material comprising toner a porous toner donor member spaced from the surface and being adapted to transport toner to a region opposed from the imaging surface; and means for conveying said developer material in the chamber of said housing onto said donor member.

10 Claims, 3 Drawing Sheets

FLUIDIZED TONER DEVELOPMENT USING A RIGID POROUS DONOR ROLL

This invention relates generally to a development apparatus for ionographic or electrophotographic imaging and printing apparatuses and machines, and more particularly is directed to a rotating, conductive porous frit donor roll for carrying toner on the surface thereof and employing air flow through the surface to form a toner cloud in the development zone for the development of a latent electrostatic image.

Generally, the process of electrophotographic printing includes charging a photoconductive member to a substantially uniform potential so as to sensitize the surface thereof. The charged portion of the photoconductive surface is exposed to a light image from either a digital imaging system [for example a scanning laser beam] or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes, that is sequentially develops, toner powder images of different color toners onto the photoreceptor prior to the transfer of the composite toner powder image onto the substrate. While the image on image process has advantages over other methods for producing color images, it has its own unique set of requirements. One such requirement is for non interactive development systems, that is those that do not scavenge or otherwise disturb a previously toned image.

Since development systems, such as conventional two component magnetic brush development and AC jumping single component development are known to disturb toner images, they are not in general suited for use in an image on image system. Thus there is a need for noninteractive development systems. There are several types of non interactive development systems that can be selected for use in an image on image system. Most use a donor roll for transporting charged toner to the development nip; the development nip is defined as the interface region between the donor roll and photoconductive member. In the development nip, the toner is developed on the latent image recorded on the photoconductive member by a combination of mechanical and/or electrical forces. It is the method by which the toner is induced to leave the donor member which primarily differentiates the several options from each other; both single component and two component methods can be utilized for loading toner onto the donor member.

In one version of a non interactive development system, a plurality of electrode wires are closely spaced from the toned donor roll in the development zone. An AC voltage is applied to the wires to generate a toner cloud in the development zone. The electrostatic fields associated with the latent image attract toner from the toner cloud to develop the latent image. It is this configuration which is utilized in both "Scavengeless Development" and "Hybrid Scavengeless Development".

In another version of non interactive development, interdigitated electrodes are provided within the surface of a donor roll. The application of an AC bias between the adjacent electrodes in the development zone causes the generation of a toner cloud.

Another type of development technology, known as jumping development, may also be configured to be non interactive. In jumping development, voltages are applied between a donor roll and the substrate of the photoreceptor member. In one version of jumping development, only a DC voltage is applied to the donor roll to prevent toner deposition in the non-image areas. In the image areas, the electric field from the closely spaced photoreceptor attracts toner from the donor. In another version of jumping development, an AC voltage is superimposed on the DC voltage for detaching toner from the donor roll and projecting the toner toward the photoconductive member so that the electrostatic fields associated with the latent image attract the toner to develop the latent image.

In a Hybrid Scavengeless Development, (HSD), housing, the plurality of small (50 to 100 micron) diameter nip wires used in the development zone to form the localized toner cloud can cause various types of defects on the prints. Perhaps the biggest problem is that the wires themselves can move relative to the donor roll. This movement of the wires can result in density non-uniformities on the prints. These density variations can be either periodic or non periodic, depending on the details of the wire motion. Other problems that can occur with the nip wires include the possibility of contaminants, such as paper fibers or large toner agglomerates, lodging in the wires, which can cause streaks to appear on the prints. These small HSD wires are also very fragile, and can easily become broken or damaged under normal use in the HSD housing, or when handling the wires, and/or installing them. The purpose of this invention is to overcome these problems.

SUMMARY OF THE INVENTION

One aspect of the invention provides for a method of noninteractive development in which the toner powder cloud is generated by air flow through a layer of toner carried by a conductive frit roll. This eliminates the need for either wires or embedded conductors as used in the present non-interactive development systems, where the cloud is generated by means of wires riding on top of the rotating donor roll or by the electric fields generated by conductive strips in the donor roll.

In existing non-interactive development systems, toner from a powder cloud is developed on the photoreceptor, and because of the gentle nature of the development system it is referred to as scavengeless in that it does not disturb the previously developed toner on the photoreceptor. In one embodiment, the cloud is generated by the electrostatic fields from the wires riding on the donor roll; in this case, there are dirt, strobing an fragility problems. In another embodiment which employs embedded conductors there are fabrication and commutation problems. The present invention provides a non-interactive development system which avoids the aforementioned problems.

Figure 1:
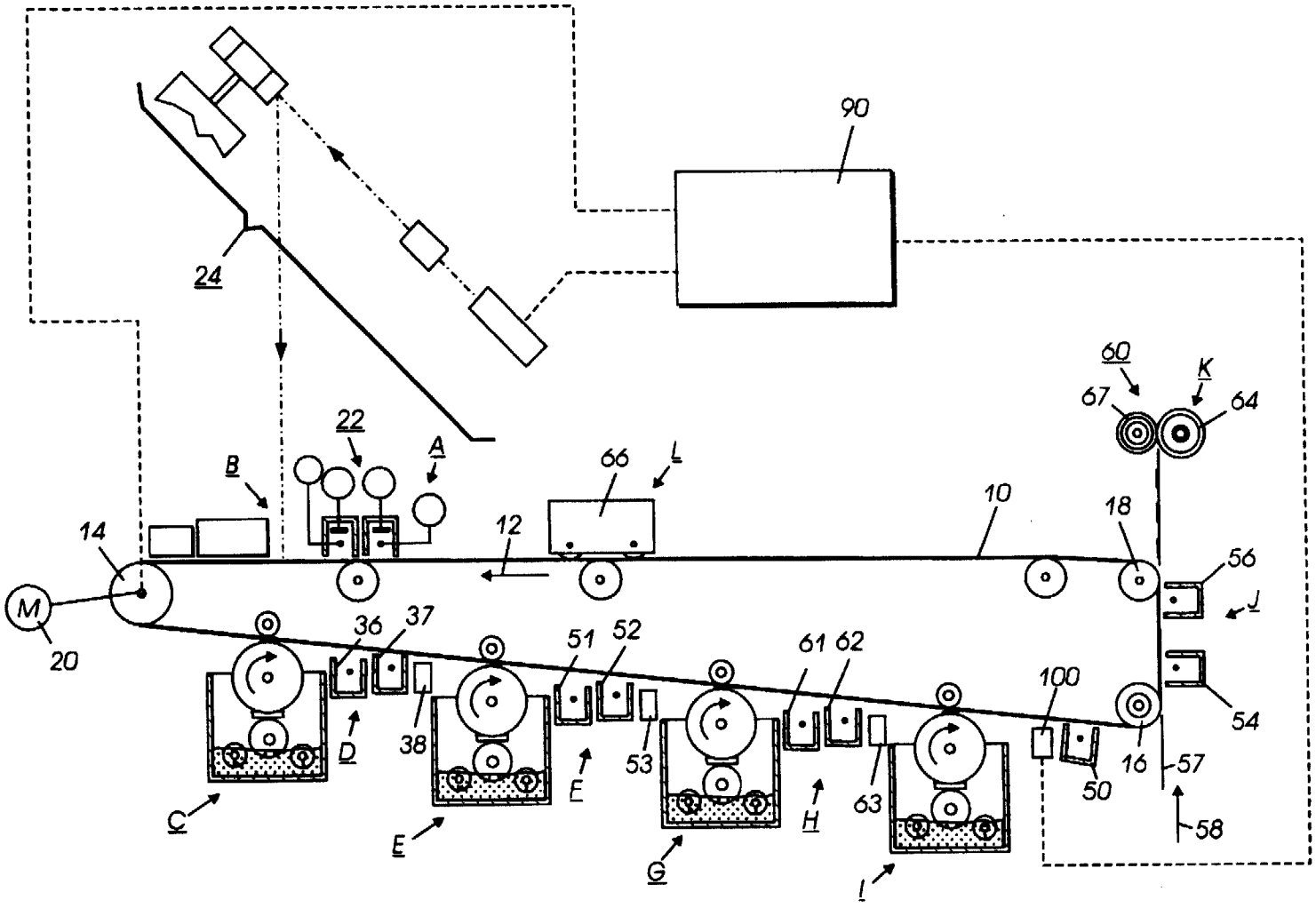
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
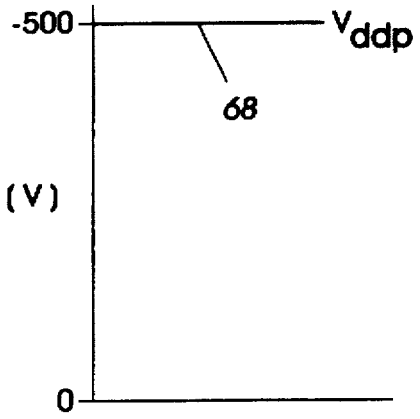
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
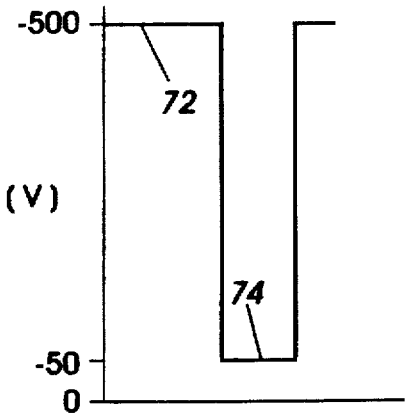
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first housing can be interactive, and thus does not have to be "Scavengeless". For purposes of this description, all four development stations are assumed to be of a non interactive nature, and all are assumed to be identical in physical configuration. The first development station C deposits a first color, say black, of negatively charged toner 31 onto the image area. That toner is attracted to the less negative sections of the image area and repelled by the more negative sections. The result is a first toner powder image on the image area.

Figure 3:
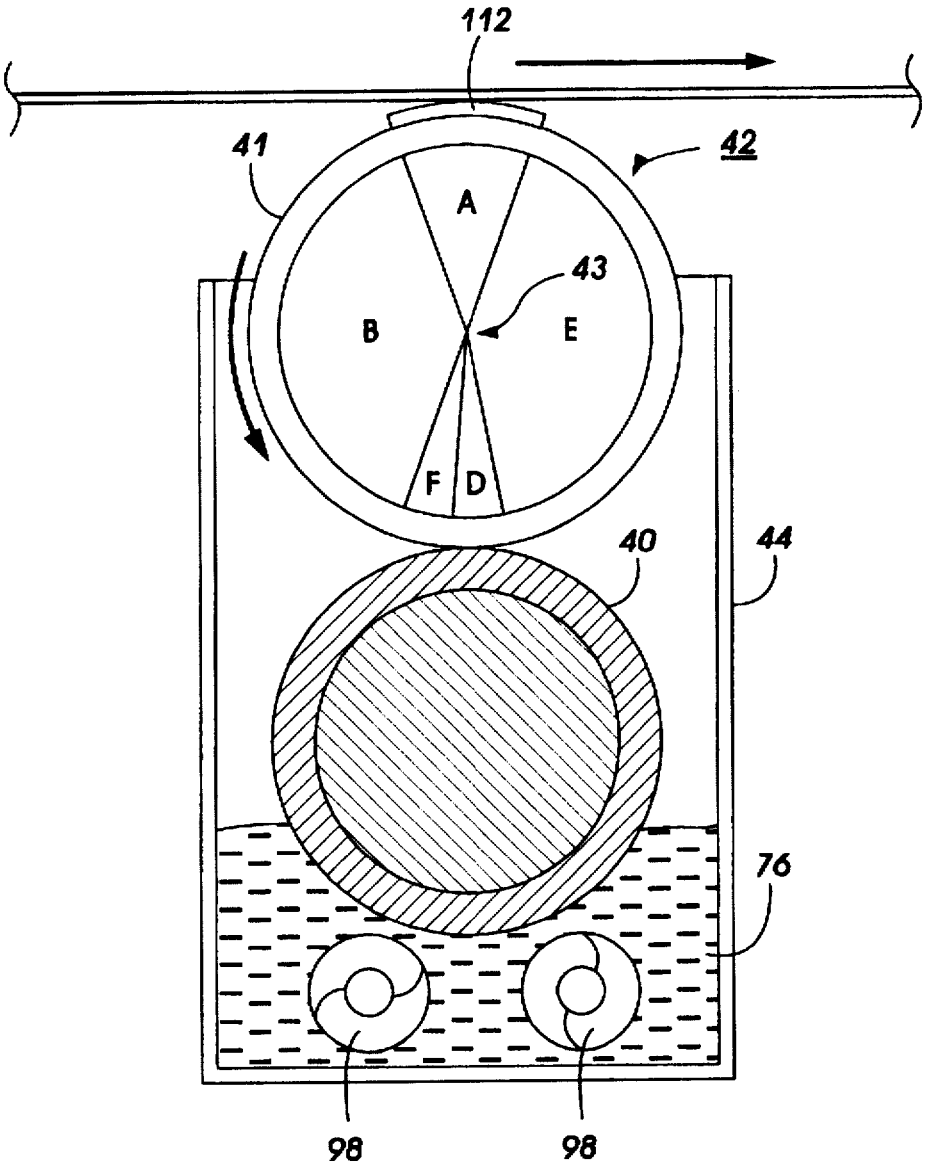
FIG. 3 is a schematic elevational view showing the development apparatus used in the FIG. 1 printing machine; and Inasmuch as the art of electrophotographic printing is well known, the various processing stations employed in the printing machine will be shown hereinafter schematically and their operation described briefly with reference thereto.

For the first development station C, development system 34 includes a porous donor roll 42; reference FIG. 3. As illustrated in FIG. 3, donor roll 42 consisting of a conductive frit 41 rotates about baffle assembly 43. A blower (not shown) connected to the baffle assembly generates an air to flow through conductive frit 41 to detach toner therefrom so as to form a toner powder cloud 112 in the gap between the donor roll and photoconductive surface. Donor roll 42 is biased at DC potentials for discharge area development (DAD). The discharged photoreceptor image attracts toner particles from the toner powder cloud to form a toner powder image thereon. Other bias configuration may be used.

Figure 2C:
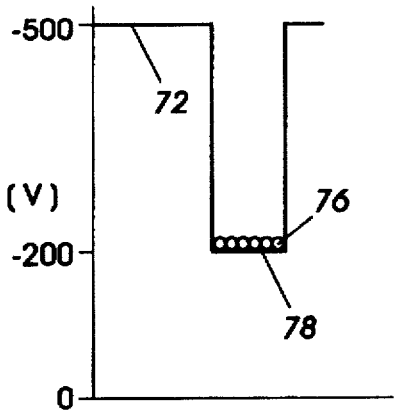
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to decrease to, for example, about −200 volts, as represented by the solid line 78. The un-illuminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
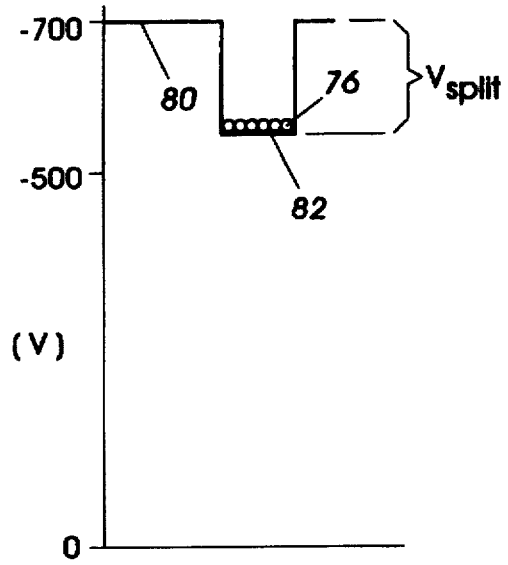
FIG. 2D shows a typical voltage profile of the image area after being recharged by a first recharging device.

FIG. 2D shows the voltages on the image area after it passes through the first recharging device 36. The first recharging device overcharges the image area to higher negative levels than that which the image area is to have when it leaves the recharging station D. For example, as shown in FIG. 2D, the untoned parts of the image area reach a voltage level 80 of about −700 volts while the toned parts, (represented by toner 76), reach a voltage level 82 of about −550 volts. The first recharging device 36 is preferably a DC scorotron.

Figure 2E:
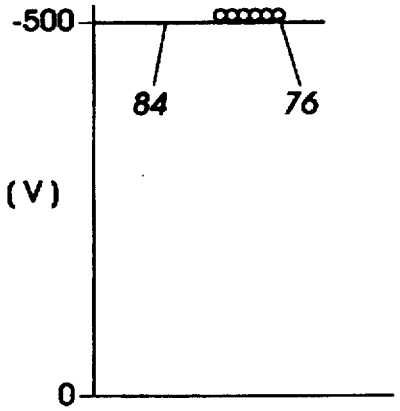
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
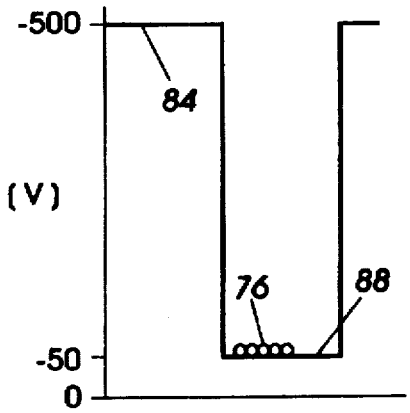
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is functionally the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same in function as the first and second exposure stations 24 and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same in function as the first, second, and third exposure stations, 24, 38, and 53 respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the back of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 3 in greater detail, development system 34 includes a donor roll 42, which consists of a conductive cylindrical frit 41, which rotates about baffle assembly 43. A blower in communication with baffle assembly generates air flow through the conductive frit 41. The air flow detaches toner from the frit so as to form a toner powder cloud 112 in the gap between the donor roll and photoconductive surface. The conductive frit is preferably made by sintering a metallic powder. The powder is size graded and the consolidated into a porous aggregate. This aggregate may then be heat treated in what is known as the no pressure sintering process, or the powder may be compressed into the required form by the application of pressure and subsequently heated to the sintering temperature. The compression technique offers the more precise thickness control and is preferred for our application. The porousity of the frit ranges between 2 to 10 microns. The thickness of frit ranges between 1 to 3 mm. The typical size of toner used is between 5 to 12 microns.

Baffle assembly 43 is sectioned into several zones of differing air flow air flow.

The baffles have a sliding seal to the inner surface of the conductive frit so as to isolate the various zones. In zone A, positive air flow is supplied to generate the toner cloud in the development zone. The air flow required to generate the toner cloud depends on the cohesivity of the toner and the porousity of the frit. A typical air flow velocity for a low cohesivity toner is about one millimeter per second, whereas for a relatively cohesive toner such as a waxy toner a flow of ten millimeters per second may be required. A useful aspect of the invention is that the air flow may be controlled so as to compensate for the increasing cohesivity that is known to occur as toner ages.

In zone B, a negative air flow may be supplied to reclaim undeveloped toner from the cloud, thereby reducing dirt generation in the machine. In zone F, a positive air flow may be supplied to remove the toner from the donor roll and return it to the sump thereby reducing the undesirable history effects that are well known in many donor roll systems. In zone D, a negative air flow is supplied to attract toner to the surface of the donor roll from the source described below. In zone E a negative flow may be maintained to control the toner blanket.

Magnetic brush 40 loads the donor roll with a two component developer, there can be selected scavengeless hybrid, as illustrated in U.S. Pat. No. 5,032,872 and U.S. Pat. No. 5,034,775 the disclosures of which are totally incorporated herein by reference. Also, U.S. Pat. No. 4,809,034 describes two-component loading of donor rolls and U.S. Pat. No. 4,876,575 discloses another combination metering and charging device suitable for use in the present invention, the disclosures of which are totally incorporated herein by reference. Toner can also be deposited on the donor roll 42 via a combination/metering and charging devices. A combination metering and charging device may comprise any suitable device for depositing a layer of well charged toner onto the donor structure 42. For example, it may comprise an apparatus, such as described in U.S. Pat. No. 4,459,009, wherein the contact between weakly charged particles and a triboelectrically active coating contained on a charging roller results in well charged toner.

It also should be noted that fluidized bed loading of the donor roll with single component developer, as illustrated is U.S. Ser. No. 08/716,076 entitled "Development System" can be also employed which is totally incorporated herein by reference.

With continued reference to FIG. 3, augers, indicated generally by the reference numeral 98, are located in chamber 76 of housing 44. Augers 98 are mounted rotatably in chamber 76 to mix and transport developer material. The augers have blades extending spirally outwardly from a shaft. The blades are designed to advance the developer material in the axial direction substantially parallel to the longitudinal axis of the shaft. As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a housing defining a chamber storing a supply of developer material comprising toner;

a porous toner donor member spaced from the surface and being adapted to transport toner to a region opposed from the imaging surface;

an air system, in communication, for supplying air to be transmitted through said donor member; and means for conveying said developer material in the chamber of said housing onto said donor member.

2. The apparatus according to claim 1, wherein said porous donor member comprising an elongated roll.

3. The apparatus according to claim 2, wherein said elongated roll has an outer circumference comprising a porous frit.

4. The apparatus according to claim 3, wherein said air system generates positive air flow moving through an interior surface of said porous frit to an exterior surface of said porous frit as to form a toner cloud for developing the latent image.

5. The apparatus according to claim 3, wherein said air handling system generates negative air flow moving through an exterior surface of said porous frit to an interior surface as to attract toner onto the exterior surface of said porous frit.

6. The apparatus according to claim 5, wherein said porous frit has a thickness ranging from 1 to 3 mm.

7. The apparatus according to claim 5, wherein said porous frit has a porosity ranging from 2 to 10 microns.

8. The apparatus according to claim 3, further comprising an air baffle, connected to said air system and disposed within said porous frit, said air baffle separating the interior surface of said porous frit into a plurality of air pressure zones.

9. The apparatus according to claim 3, wherein one of said plurality of air pressure zones is opposed from the imaging surface for forming a toner cloud for developing the latent image.

10. The apparatus according to claim 3, wherein said porous frit comprises a conductive material.

* * * * *